US006346002B1

(12) United States Patent
Hsu et al.

(10) Patent No.: US 6,346,002 B1
(45) Date of Patent: Feb. 12, 2002

(54) CONNECTOR EQUIPPED WITH SNAP LATCHING STRUCTURE

(75) Inventors: Ivan Hsu, Pan Chiao; Mark Chen, Taipei, both of (TW)

(73) Assignee: Wieson Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 09/835,512

(22) Filed: Apr. 17, 2001

(51) Int. Cl.[7] ..... H01R 13/627
(52) U.S. Cl. ..... 439/358; 439/353; 439/352
(58) Field of Search ..... 439/352, 353, 439/345, 357, 358

(56) References Cited

U.S. PATENT DOCUMENTS 5,660,558 A * 8/1997 Osanai et al. ..... 439/353
5,779,495 A * 7/1998 Dechelette et al. ..... 439/353

* cited by examiner

*Primary Examiner*—Tho D. Ta
(74) *Attorney, Agent, or Firm*—Rosenberg, Klein & Lee

(57) ABSTRACT

A connector equipped with snap latching structure includes a body, a latch member, a sleeve member and a socket. The body has a coupling section for engagement with the socket. The latch member is disposed in a recessed section of the coupling section of the body. The sleeve is disposed in the recessed section of the body to cover the latch member. The latch member has a pair of hook arms engageable with the wedge slots formed at the coupling section of the body. When the coupling section of the body engages with the socket, the hook arms latch with the side stubs located at two sides of the socket for preventing the connector from disengaging from the socket.

5 Claims, 5 Drawing Sheets

CONNECTOR EQUIPPED WITH SNAP LATCHING STRUCTURE

BACKGROUND OF THE INVENTION

Field of the Invention

The present invention relates to a connector which has a snap latching structure and particularly to a connector that has a snap latching structure for preventing the connector from disengaging from a socket.

Description of the of the Prior Art

Connectors are widely used in a plurality of technological products nowadays. They also have a wide variety of specifications, such as USB, IEEE, and the like. Some connectors are designed to connect a plurality of wires. The weight of the wires generates an excessive load at the rear end of a connector, that may result in an unwanted displacement of the head portion of the connector when it is plugged in a socket. This phenomenon may cause poor connection between the connector and socket, and even malfunction of electronic products.

SUMMARY OF THE INVENTION

In view of aforesaid disadvantages, it is therefore an object of the present invention to provide an improved connector which has a snap latch member to enable the connector to engage with a socket securely without the risk of unwanted disengagement.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
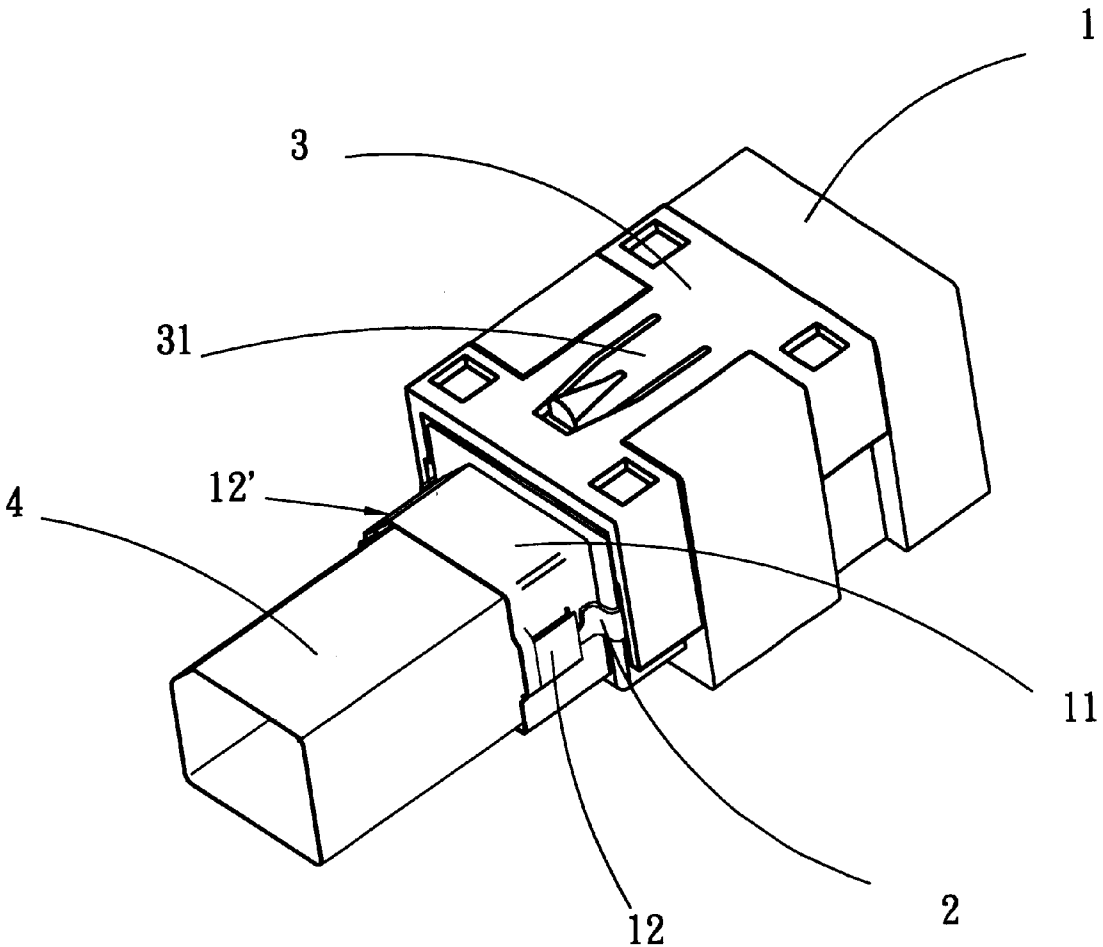
FIG. 1 is a perspective view of the connector of the present invention.
Figure 2:
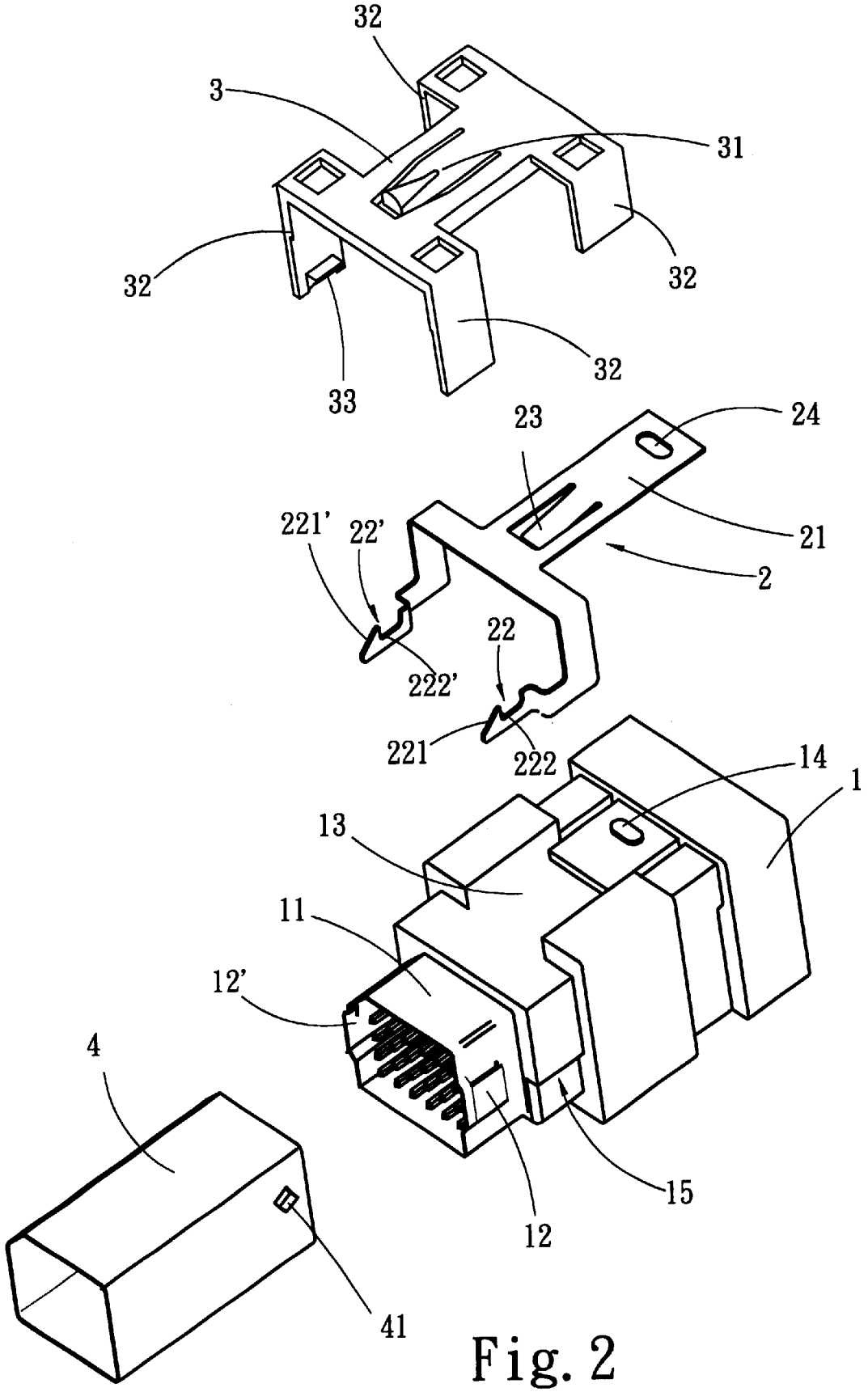
FIG. 2 is an exploded view of the connector of the present invention.
Figure 3:
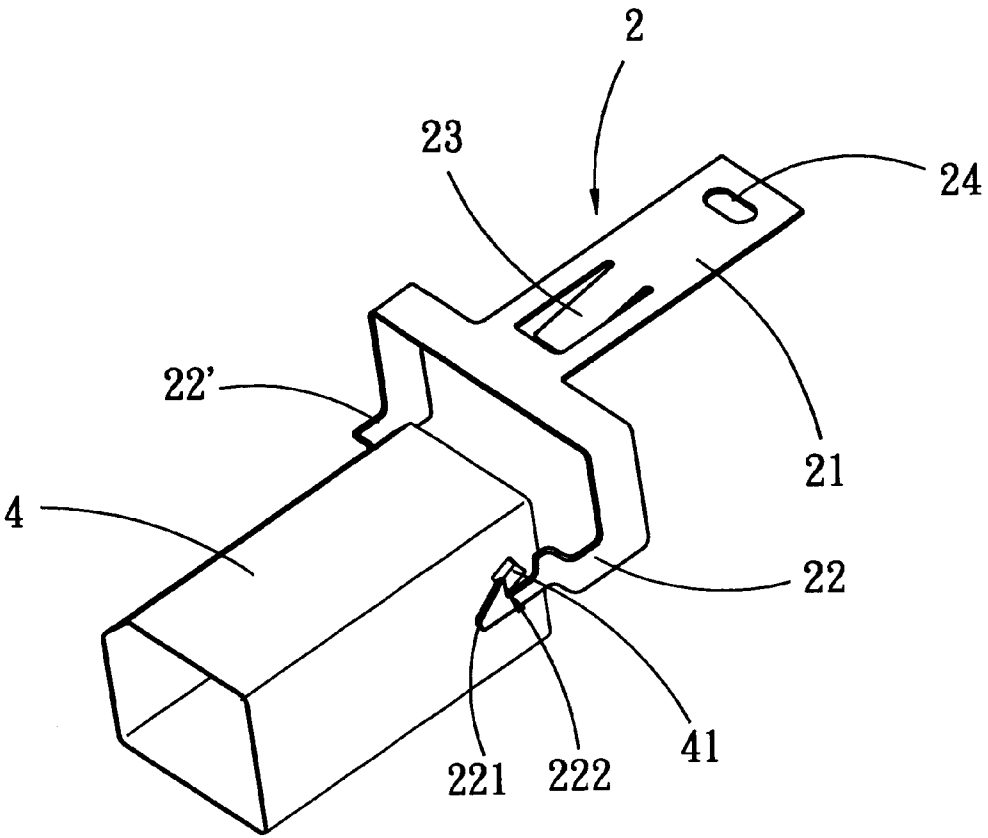
FIG. 3 is a perspective view of the connector of the present invention, showing a latch member coupled with a socket.
Figure 5:
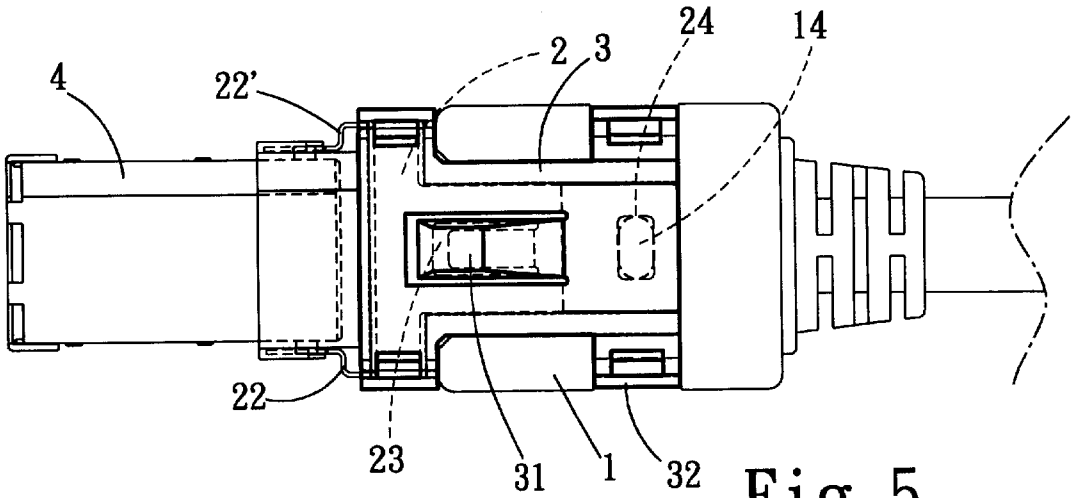
FIG. 5 is a top view of the connector of the present invention coupled with a socket.
Figure 4:
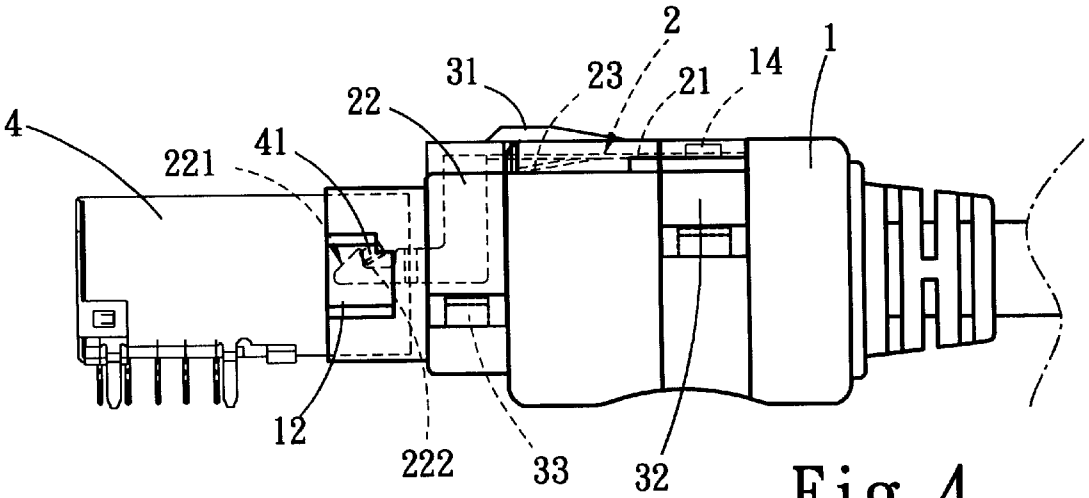
FIG. 4 is a side view of the connector of the present invention coupled with a socket.
Figure 6:
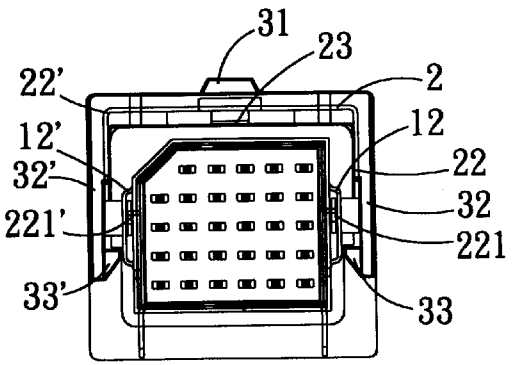
FIG. 6 is a front view of the connector of the present invention coupled with a socket.

Referring to FIGS. 1 and 2, the connector according to the present invention includes at least a body 1, a latch member 2, a sleeve member 3 and a socket 4. The body 1 has a coupling section 11 at a front end thereof. The coupling section 11 has two wedge slots 12 and 12' formed at two lateral sides thereof, a stepwise indent section 15 behind the wedge slots 12 and 12', a recessed section 13 formed at the top of the coupling section 11, and a stub 14 located at the rear end of the recessed section 13.

The latch member 2 has an elongated lever 21 which has at one end thereof two symmetrical book arms 22 and 22' extended downwards at the two sides of the lever 21, an elastic tongue 23 located at the top of the lever 21, and a bore 24 formed at the rear end of the lever 21. The bore 24 is aligned and engageable with the stub 14. The hook arms 22 and 22' have respectively a front slant tip 221 and 221', and a latch edge 222 and 222' opposite to the slant tip 221 and 221'.

The sleeve member 3 is substantially formed in a H shape for mating against the recess section 13 and has four legs 32 bent downwards. It has a press lever 31 located at the top side thereof. Two front legs 32 have respectively a snap lug 33 formed at the bottom end of the inner side walls thereof.

The socket 4 has two side stubs 41 formed at two lateral sides thereof. To assemble the connector of the present invention, the latch member 2 is disposed over the body 1 with the bore 24 engaging with the stub 14 and the lever 21 disposed in the recessed section 13, and the hook arms 22 and 22' engaging the wedge slots 12 and 12'. Then, the sleeve member 3 is disposed in the recessed section 13 to clamp the legs 32 over two sides of the body 1 with the lugs 33 clipped the indented section 15 thereby enabling the latch member 2 to be engaged securely in the recessed section 13.

Referring to FIGS. 3 through 6, in order to engage the coupling section 11 of the body 1 with the socket 4, the slant tip 221 and 221' will enable the hook arms 22 and 22' to move downwards to pass over the side stubs 41, and the latch member 2 will also be moved downwards to force the compressed elastic tongue 23 to press against the top side of the recessed section 13. This constitutes an engagement state in which the connector body 1 is engaged securely with tile socket 4 with no risk of breaking away.

Figure 7A:
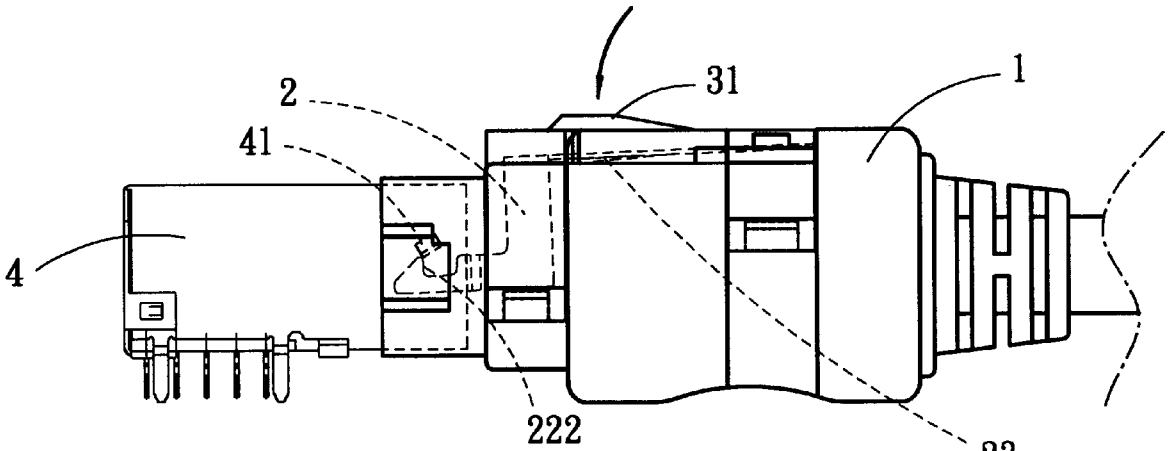
FIG. 7A is a schematic view of the connector of the present invention disengaging from a socket.
Figure 7B:
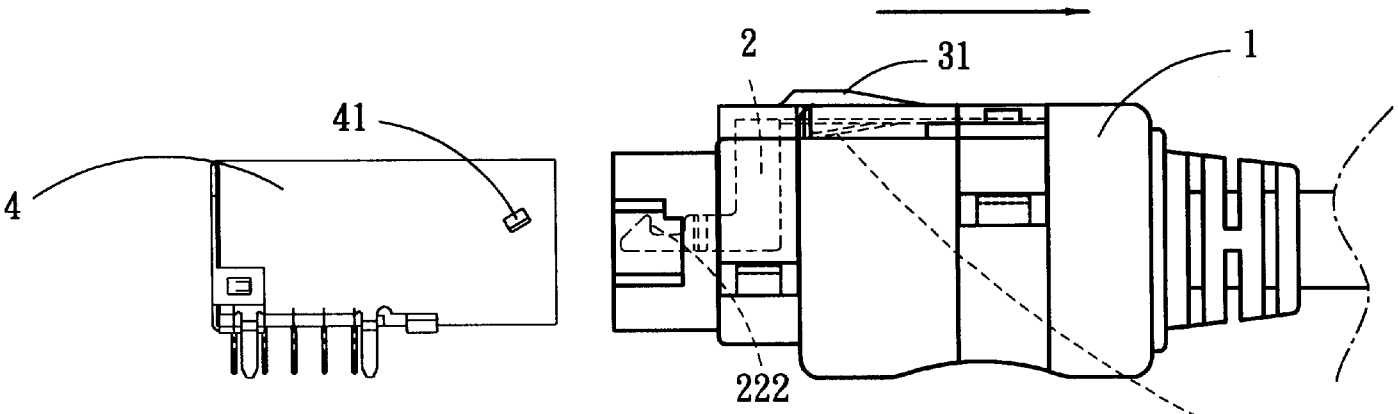
FIG. 7B is a schematic view of the connector of the present invention detached from a socket.

Referring to FIGS. 7A and 7B, for disengaging the connector from the socket, the press lever 31 is pressed downwards which also pushes the latch member 2 downwards, so that the latch edges 222 and 222' are moved away from the side stubs 41. The connector thus may be moved away from the socket 4. After the connector is detached from the socket, absence of the pressing force from the press lever 31 allows the restoration force of the elastic tongue 23 to raise the latch member 2 to its initial position for use next time.

While the preferred embodiment of the present invention has been set forth for purpose of disclosure, modifications of the disclosed embodiment of the invention as well as other embodiments thereof may occur to those skilled in the art. Accordingly, the appended Claims are intended to cover all embodiments which do not depart from the spirit and scope of the present invention.

What is claimed is:

1. A connector equipped with snap latching structure for engaging the connector securely with a socket, comprising:

a body having a coupling section at a front end which has two wedge slots formed at two lateral sides thereof and a recess section formed at a top side thereof, a latch member having an elongated lever which has one end extended downwards at two sides thereof to form two symmetrical hook arms and an elastic tongue located at a top side thereof, wherein the elastic tongue is biased against the recess section and the hook arms wedged in the wedge slots when the latch member is disposed in the recess section;

a sleeve member having a press lever located at a top side thereof, the sleeve member being disposed on the latch member;

wherein, when the coupling section is connected to the socket, the hook arms are engaged with two side stubs formed at two lateral sides of the socket in order to prevent the coupling section from disengaging from the socket;

wherein, when the coupling section is disconnected from the socket, the press lever is pressed downwards to push the latch member downwards, thus resulting in disengaging the hook arms from the side stubs; and wherein, after the coupling section is disconnected from the socket, the biasing force of the elastic tongue is restored to raise the latch member to initial position thereof.

2. The connector of claim 1, wherein the recess section has a stub located at a rear end thereof mating against a bore formed at another end of the lever.

3. The connector of claim 1, wherein die sleeve is formed in an H shape and has four legs each having a free end extending downwards for engaging the body.

4. The connector of claim 1, wherein the hook arms have respectively slant tip formed at a front end thereof and a latch edge formed behind the slant tip.

5. The connector of claim 3, wherein two of the four legs are located at a front side of the sleeve, each of said two legs having a snap lug formed at the bottom end of the inside wall thereof.

* * * * *